US011027403B2

(12) United States Patent
Beckhusen et al.

(10) Patent No.: US 11,027,403 B2
(45) Date of Patent: Jun. 8, 2021

(54) HYDRAULIC HAMMER

(71) Applicant: Caterpillar Inc., Deerfield, IL (US)

(72) Inventors: Jordan Beckhusen, Mcgregor, TX (US); Cody Moore, Waco, TX (US); Jason Ray Walker, Steeleville, IL (US)

(73) Assignee: Caterpillar Inc., Peoria, IL (US)

( * ) Notice: Subject to any disclaimer, the term of this patent is extended or adjusted under 35 U.S.C. 154(b) by 161 days.

(21) Appl. No.: 16/011,001

(22) Filed: Jun. 18, 2018

(65) Prior Publication Data

US 2019/0381645 A1 Dec. 19, 2019

(51) Int. Cl.

| | |
|---|---|
| ***B25D 9/18*** | (2006.01) |
| ***B25D 9/04*** | (2006.01) |
| ***B25D 17/00*** | (2006.01) |
| ***E02F 3/96*** | (2006.01) |

(52) U.S. Cl.

CPC ..... *B25D 9/18* (2013.01); *B25D 9/04* (2013.01); *B25D 17/00* (2013.01); *E02F 3/966* (2013.01); *B25D 2250/125* (2013.01)

(58) Field of Classification Search

CPC .. B25D 17/00; B25D 17/24; B25D 2250/125; E02F 3/966

USPC ..... 173/90, 112, 210, 162.1, 200; 299/100, 299/37.5

See application file for complete search history.

(56) References Cited

U.S. PATENT DOCUMENTS

| | | | | |
|---|---|---|---|---|
| 4,906,049 | A | 3/1990 | Anderson | |
| 6,095,257 | A * | 8/2000 | Lee | B25D 17/24 173/211 |
| 7,628,222 | B2 * | 12/2009 | Yoshimura | E04G 23/082 173/162.1 |
| 9,821,447 | B2 * | 11/2017 | Robson | B25D 17/24 |
| 2012/0145426 | A1 * | 6/2012 | Nickels | B25D 17/24 173/210 |
| 2012/0152581 | A1 * | 6/2012 | Pillers, II | B25D 17/24 173/162.1 |
| 2014/0144659 | A1 * | 5/2014 | Nickels | B25D 17/00 173/90 |
| 2016/0067858 | A1 * | 3/2016 | Moore | E02F 3/966 173/90 |
| 2016/0199969 | A1 * | 7/2016 | Moore | B25D 9/145 173/115 |
| 2016/0303728 | A1 * | 10/2016 | Chapagain | B25D 17/24 |
| 2017/0036336 | A1 * | 2/2017 | Moore | B25D 17/08 |
| 2017/0087706 | A1 * | 3/2017 | Moore | B25D 17/06 |
| 2017/0157759 | A1 * | 6/2017 | Moore | E02F 3/966 |
| 2017/0167962 | A1 * | 6/2017 | Moore | B25D 9/00 |

(Continued)

FOREIGN PATENT DOCUMENTS

| | | |
|---|---|---|
| JP | 2005001063 | 1/2005 |
| JP | 2015160283 | 9/2015 |
| JP | 2016094644 | 5/2016 |

(Continued)

*Primary Examiner* — Valentin Neacsu

(57) ABSTRACT

A hydraulic hammer includes a housing defining a cutout and a power cell slidably received within the housing. The power cell includes a valve assembly extending from a side of the power cell. The valve assembly is at least partially received within the cutout of the housing. The hydraulic hammer further includes a pair of wear plates at least partially disposed around the valve assembly of the power cell. Each of the pair of wear plates is coupled to at least one of the power cell and the housing.

20 Claims, 14 Drawing Sheets

(56) References Cited

U.S. PATENT DOCUMENTS

| | | | | |
|---|---|---|---|---|
| 2017/0274516 | A1* | 9/2017 | Jeon | B25D 9/04 |
| 2018/0104806 | A1* | 4/2018 | Moore | E02F 3/966 |

FOREIGN PATENT DOCUMENTS

| | | |
|---|---|---|
| KR | 20160103316 | 9/2016 |
| WO | 9802283 | 1/1998 |
| WO | 2006033504 | 3/2006 |
| WO | 2016105028 | 6/2016 |

* cited by examiner

202

HYDRAULIC HAMMER

TECHNICAL FIELD

The present disclosure relates to a hydraulic hammer. More particularly, the present disclosure relates to a hydraulic hammer with an external valve assembly.

BACKGROUND

Hydraulic hammers are used at various work sites for breaking up hard objects, such as rocks, concrete, asphalt, frozen ground, and other materials. The hydraulic hammers may be mounted on a machine, such as an excavator, a dozer, a loader, a motor grader, and the like. Typically, the hydraulic hammers include a housing, a power cell enclosed within the housing, and a mounting bracket disposed on the housing. The power cell is positioned within the housing and coupled with a tool that extends out of the housing. The power cell may be operated pneumatically or hydraulically for actuating the tool for performing various operations on a work surface. The power cell generally includes a valve assembly for regulating fluid flow to and from the power cell. Some power cells may have an external valve assembly.

The power cell may have to be removed from the housing of the hydraulic hammer for servicing and/or replacement. Hydraulic hammers with external valve assembly may require removal of multiple parts, for example, pins, wear members, and the mounting bracket, to remove the power cell from the housing. This may result in additional downtime and requirement of various tools to service and/or replace the power cell.

Korean Patent Publication Number 20160103316 describes an improved breaker which has improvement points with respect to a control valve structure for a breaker, a piston structure for a breaker having an actuating surface using an inclination structure, and a gas chamber structure for expanding the capacity thereof. The control valve for a breaker, which is installed in a valve room to switch the direction of fluid in a breaker, includes: a valve housing; a valve spool which is fitted to come in contact with the inner surface of the valve housing; and a valve plug which is fitted to come in contact with the inner surface of the valve spool.

SUMMARY OF THE DISCLOSURE

In an aspect of the present disclosure, a hydraulic hammer is provided. The hydraulic hammer includes a housing defining a cutout and a power cell slidably received within the housing. The power cell includes a valve assembly extending from a side of the power cell. The valve assembly is at least partially received within the cutout of the housing. The hydraulic hammer further includes a pair of wear plates at least partially disposed around the valve assembly of the power cell. Each of the pair of wear plates is coupled to at least one of the power cell and the housing.

In another aspect of the present disclosure, a hydraulic hammer is provided. The hydraulic hammer includes a housing defining a cutout and a power cell slidably received within the housing. The cutout is U-shaped. The power cell includes a valve assembly extending from a side of the power cell and a plurality of apertures disposed around the valve assembly. The valve assembly is at least partially received within the cutout of the housing. The hydraulic hammer further includes a pair of wear plates at least partially disposed around the valve assembly of the power cell. Each of the pair of wear plates includes a pair of projecting portions adapted to be removably received within corresponding apertures of the plurality of apertures of the power cell.

In yet another aspect of the present disclosure, a hydraulic hammer is provided. The hydraulic hammer includes a housing having a top end and a bottom end. The housing further defines a cutout. The hydraulic hammer further includes a power cell slidably received within the housing. The power cell includes a valve assembly extending from a side of the power cell. The valve assembly is at least partially received within the cutout of the housing. The hydraulic hammer further includes a pair of wear plates at least partially disposed around the valve assembly of the power cell. Each of the pair of wear plates is coupled to at least one of the power cell and the housing. The hydraulic hammer further includes a top buffer disposed proximate to the top end of the housing. The hydraulic hammer also includes a bottom buffer disposed proximate to the bottom end of the housing.

Other features and aspects of this disclosure will be apparent from the following description and the accompanying drawings.

DETAILED DESCRIPTION

Figure 1:
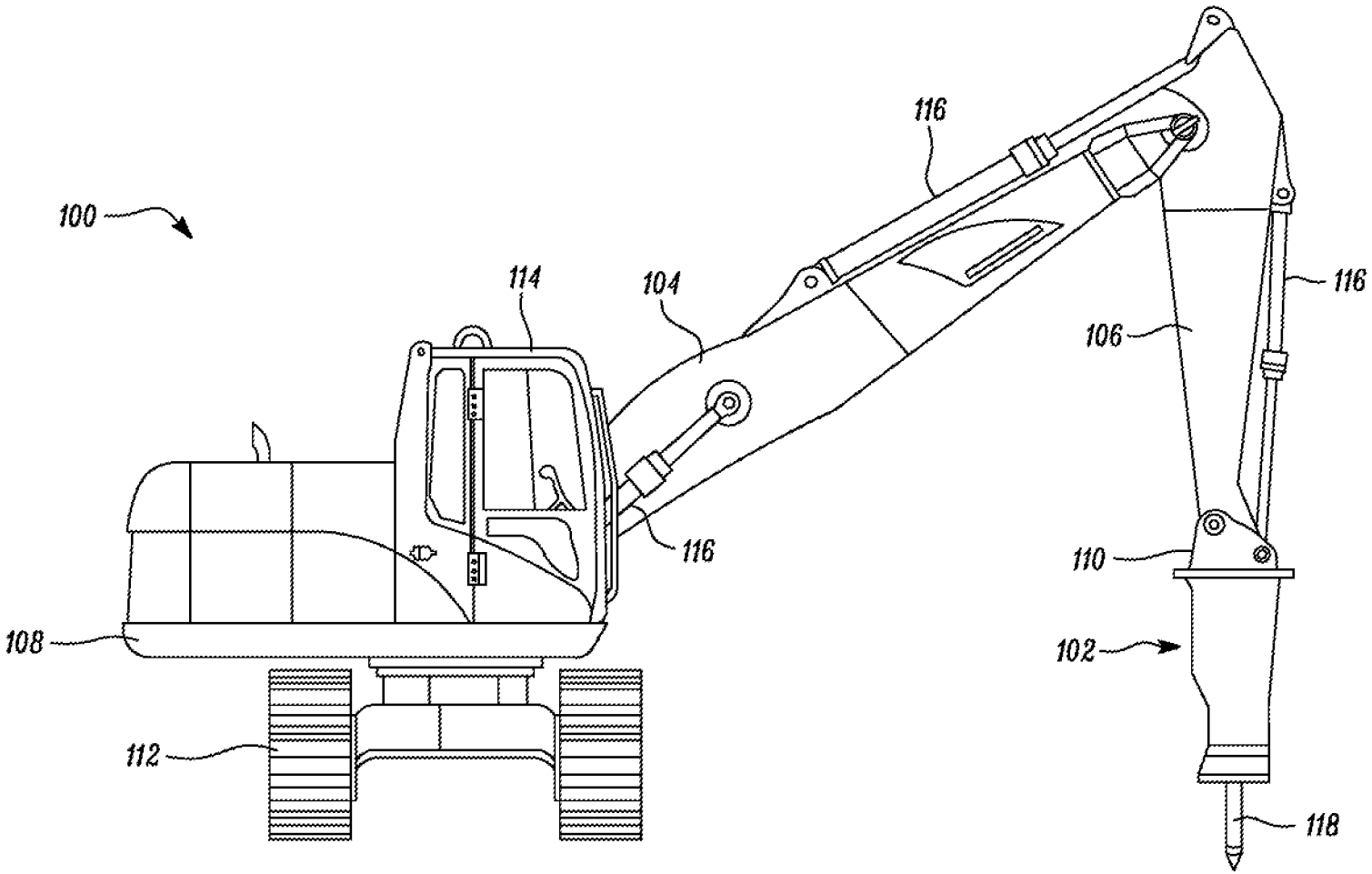
FIG. 1 is a side view of an exemplary machine incorporating a hydraulic hammer, according to one embodiment of the present disclosure.

Wherever possible, the same reference numbers will be used throughout the drawings to refer to the same or the like parts. Referring to FIG. 1, an exemplary machine 100 employing a hydraulic hammer 102 (hereinafter referred to as "the hammer 102") is illustrated. The machine 100 may be an excavator (shown in FIG. 1), a backhoe loader, a skid steer loader, dozer, a motor grader, or any other type of machine. The machine 100 may perform work associated with a particular industry including, but not limited to, construction, mining, agriculture, waste management, material handling, and forestry.

The machine 100 includes linkages, such as a boom 104 and a stick 106. The boom 104 is pivotally connected to a frame 108 of the machine 100. Further, the stick 106 is pivotally connected to the boom 104. A mounting bracket 110 pivotally connects the hammer 102 to the stick 106. The hammer 102 may replace an excavator bucket.

The machine 100 includes a drive system 112, such as tracks, for propelling the machine 100. The frame 108 is rotatable about a vertical axis (not shown) with respect to the drive system 112. The machine 100 further includes an operator cab 114 having user interface devices for controlling the boom 104, the stick 106, the drive system 112, and the hammer 102. One or more hydraulic cylinders 116 may raise, lower, and/or swing the boom 104, the stick 106, and the mounting bracket 110 to correspondingly raise, lower, and/or swing the hammer 102.

The hammer 102 includes a work tool 118 that may be operated to break up or demolish hard objects, such as rocks, concrete, asphalt, frozen ground, and other materials. It is contemplated that the work tool 118 may include any tool capable of use with the hammer 102. In one embodiment, work tool 118 may include a chisel bit. Further, the hammer 102 may be powered hydraulically, pneumatically, or a combination thereof for actuation of the work tool 118.

Figure 2:
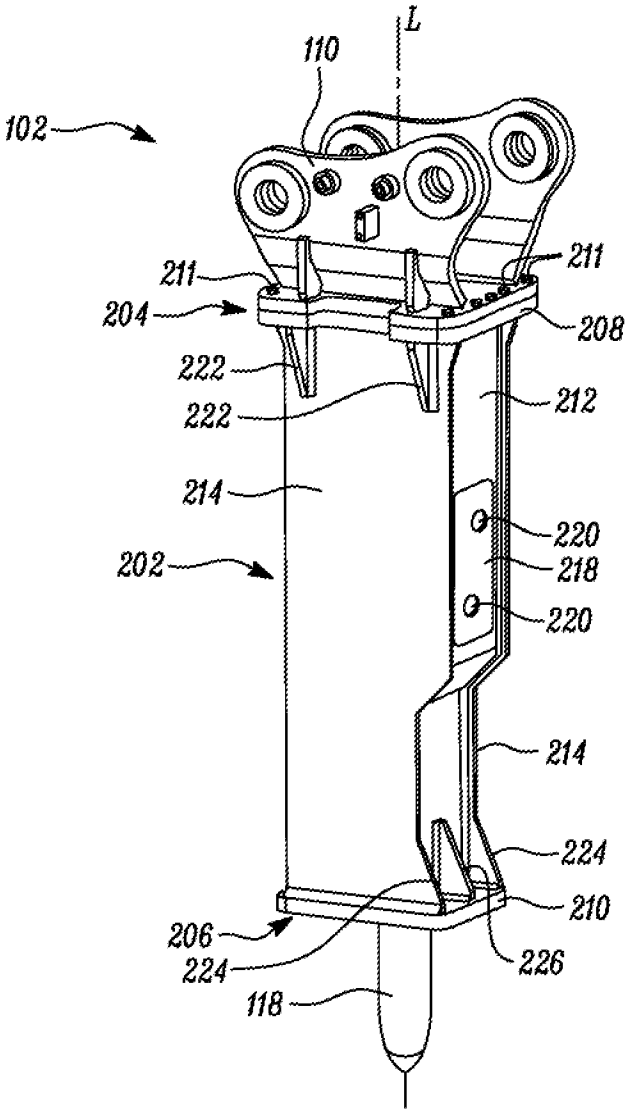
FIG. 2 is a perspective view of the hydraulic hammer, according to one embodiment of the present disclosure.

FIG. 2 illustrates a perspective view of the hammer 102. The hammer 102 includes a housing 202 that encloses one or more components of the hammer 102. The housing 202 defines a longitudinal axis 'L' along its length. Further, the housing 202 defines a top end 204 and a bottom end 206 with respect to the longitudinal axis 'L'. The housing 202 includes a top flange 208 at the top end 204 and a bottom flange 210 at the bottom end 206. The top flange 208 is detachably coupled to the mounting bracket 110 via multiple fasteners 211. Further, the work tool 118 extends through the bottom flange 210.

The housing 202 also includes a front external wall 212 (hereinafter referred to as "the external wall 212"), a pair of side walls 214 disposed opposite to one another, and a rear wall 215 (shown in FIGS. 5 and 8) disposed opposite to the external wall 212. The external wall 212 defines a front opening 216 (shown in FIG. 3) extending therethrough. The external wall 212 is located between the side walls 214. Further, the side walls 214 may extend beyond the external wall 212. The front opening 216 is covered by a dust cover 218 that defines a pair of cover holes 220. Each of the cover holes 220 may receive a fluid conduit (not shown) therethrough. The fluid conduits may provide supply and discharge paths for a working fluid of the hammer 102. The housing 202 further includes a pair of top reinforcing portions 222 connected to the top flange 208 and each of the side walls 214. In an embodiment, the top reinforcing portions 222 may be welded to the top flange 208 and the corresponding side wall 214. Each of the top reinforcing portions 222 may have a substantially triangular shape. Each of the side walls 214 includes a side handling portion 224 connected to the bottom flange 210. A bottom handling portion 226 is further connected to the external wall 212 and the bottom flange 210. In an embodiment, the bottom handling portion 226 may be welded to the external wall 212 and the bottom flange 210. Each of the side and bottom handling portions 224, 226 may have a substantially triangular shape. The side and bottom handling portions 224, 226 may point towards the operator cab 114 (shown in FIG. 1) of the machine 100 and are used for material handling.

In various embodiments, different parts of the housing 202 may be connected to each other by various methods, such as welding, brazing, adhesives, mechanical fasteners, and the like. In an alternative embodiment, the housing 202 may include a one-piece configuration. Further, the housing 202 may be made of a metal, an alloy, a plastic, a composite, or any other suitable material.

Figure 3:
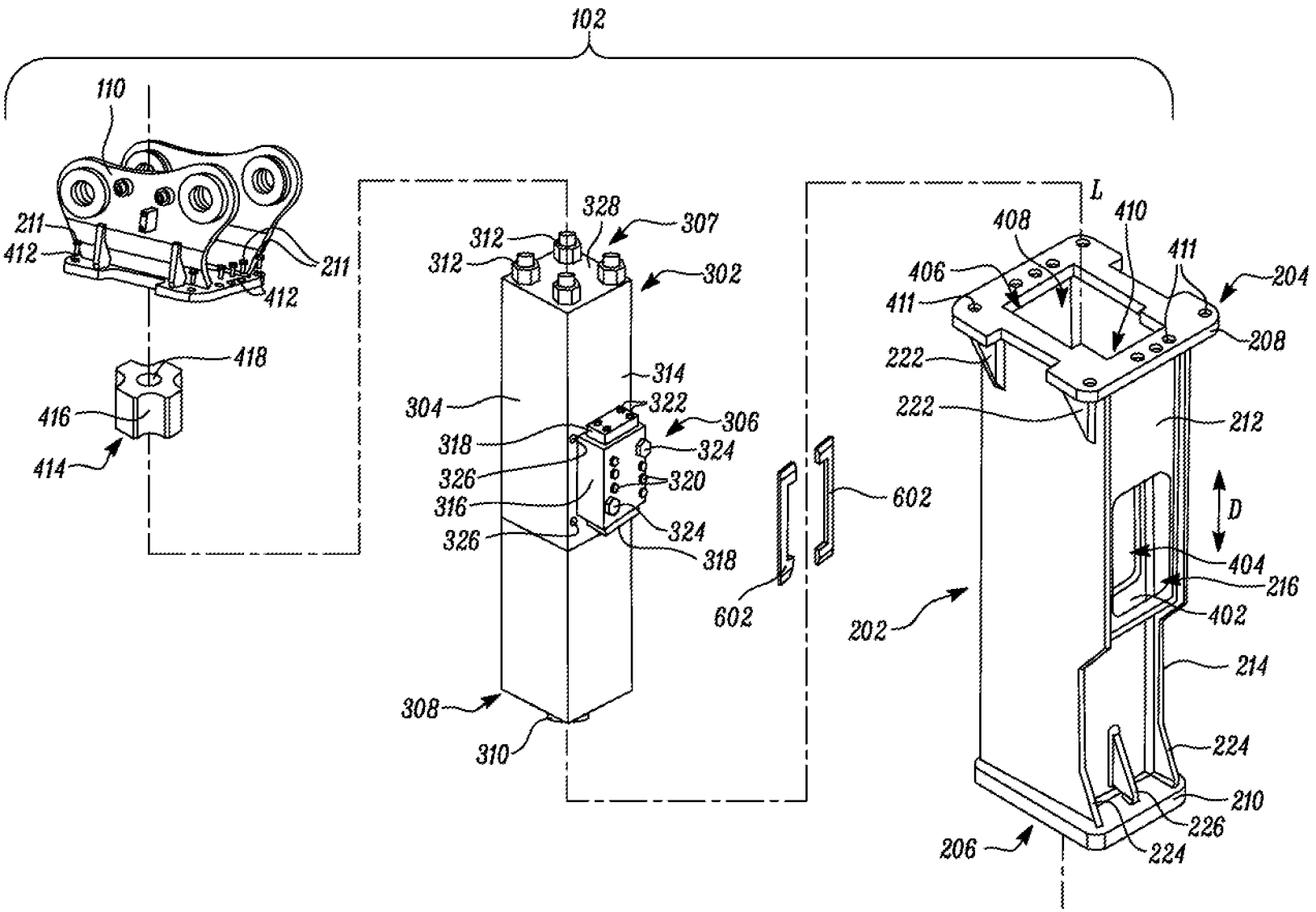
FIG. 3 is an exploded view of the hydraulic hammer, according to one embodiment of the present disclosure.

FIG. 3 illustrates an exploded view of the hammer 102. Several components of the hammer 102, such as the work tool 118 and the dust cover 218, have been omitted in FIG. 3 for the purpose of clarity. The hammer 102 includes a power cell 302 that is slidably and removably received within the housing 202. Specifically, the power cell 302 may be slidably received within or removed from the housing 202 along an axial direction 'D'. The axial direction 'D' may be substantially parallel to the longitudinal axis 'L' of the housing 202. The power cell 302 includes a main housing 304 and a valve assembly 306. The main housing 304 defines a first end 307 and a second end 308 opposite to the first end 307. In the illustrated embodiment, the main housing 304 has a substantially rectangular cross-section. However, the main housing 304 may have any other suitable shape as per application requirements. The main housing 304 may enclose one or more working components of the power cell 302 for actuating the work tool 118 (shown in FIG. 2). Specifically, power cell 302 may include a piston 502 (shown schematically in FIG. 4) disposed inside the main housing 304 and other components (not shown). The piston 502 may reciprocate inside the main housing 304 during operation of the hammer 102. The power cell 302 may further include a bottom part 310 extending from the second end 308 of the housing 202. The work tool 118 may extend from the bottom part 310. Further, the work tool 118 may be operatively connected to the power cell 302 at the bottom part 310. In an embodiment, the bottom part 310 may have a hollow cylindrical shape. The power cell 302 further includes multiple nut and bolt assemblies 312 that project from the first end 307 of the main housing 304. The nut and bolt assemblies 312 may retain various components of the power cell 302 within the main housing 304.

The valve assembly 306 extends from a side 314 of the main housing 304. Specifically, the valve assembly 306 may extend transversely from the side 314 of the main housing 304. The valve assembly 306 may regulate flow of the working fluid to and from the power cell 302 in order to actuate the piston 502. The valve assembly 306 may therefore constitute an external valve assembly of the power cell 302, i.e., the valve assembly 306 is disposed externally to the main housing 304. The valve assembly 306 includes a main portion 316 and a pair of securing members 318 disposed at opposite ends of the main portion 316. The main portion 316 may form a valve housing and encloses one or more components of the valve assembly 306. The main portion 316 may be connected to the main housing 304 of the power cell 302 via multiple first fasteners 320. Further, each of the securing member 318 in cooperation with multiple second fasteners 322 may retain various components within the main portion 316 of the valve assembly 306. The valve assembly 306 further includes a pair of fluid connectors 324 disposed on the main portion 316. The fluid connectors 324 may connect with corresponding fluid conduits for intake and discharge of the working fluid from the valve assembly 306. The main housing 304 of the power cell 302 further defines multiple apertures 326 around the valve assembly 306. The multiple apertures 326 may receive a pair of wear plates 602. In an alternative embodiment, the wear plates 602 may be coupled to the housing 202. The wear plates 602 are at least partially disposed around the valve assembly 306 of the power cell 302.

The housing 202 further includes an internal wall 402 spaced apart from the external wall 212. The internal wall 402 defines a cutout 404. The valve assembly 306 is at least partially received within the cutout 404 upon insertion of the power cell 302 within the housing 202. Further, the valve assembly 306 extends through the cutout 404 towards the external wall 212 upon insertion of the power cell 302 within the housing 202. In the illustrated embodiment, the cutout 404 is U-shaped. However, the cutout 404 may have any other alternative shape based on the shape of the valve assembly 306. The cutout 404 and the front opening 216 may be substantially aligned with each other such that the fluid conduits received through the cover holes 220 (shown in FIG. 2) of the dust cover 218 may be attachable to the corresponding fluid connectors 324 of the valve assembly 306. The external wall 212 along with the dust cover 218 may therefore act as a cover for the valve assembly 306.

The housing 202 further defines a house opening 406 originating at the top end 204 for receiving the power cell 302 within the housing 202. The house opening 406 includes a first portion 408 and a second portion 410 adjacent to the first portion 408. The first portion 408 may receive the main housing 304 of the power cell 302. Further, the second portion 410 may receive the valve assembly 306 of the power cell 302. The first and second portions 408, 410 of the house opening 406 may extend at least partially along the length of the housing 202. Each of the first portion 408 and the second portion 410 has a substantially rectangular shape. However, an area of the first portion 408 is larger than an area of the second portion 410.

The top flange 208 further defines multiple flange apertures 411. The mounting bracket 110 also defines corresponding bracket apertures 412. The flange apertures 411 and the corresponding bracket apertures 412 receive the corresponding fasteners 211 for removably securing the mounting bracket 110 to the top flange 208 of the housing 202. The hammer 102 further includes a top buffer 414 that is disposed proximate to the top end 204 of the housing 202. In an embodiment, the top buffer 414 may be retained between the mounting bracket 110 and the top flange 208 of the housing 202. The top buffer 414 may further rest on a top surface 328 of the main housing 304 of the power cell 302. The top buffer 414 includes multiple recessed portions 416 for accommodating the nut and bolt assemblies 312 extending from the top surface 328 of the power cell 302. The top buffer 414 further defines a hole 418 extending therethrough.

The cutout 404 may allow the power cell 302 to be easily inserted into or removed from the housing 202. Specifically, the valve assembly 306 may slide into the cutout 404 upon insertion of the power cell 302 into the housing 202. In order to remove the power cell 302 from the housing 202, the mounting bracket 110 may have to be disconnected and removed from the top flange 208 of the housing 202. The top buffer 414 which rests on the top surface 328 of the power cell 302 may be easily removed without using any tools. The power cell 302 including the valve assembly 306 may be then slidably removed from the housing 202.

Figure 4:
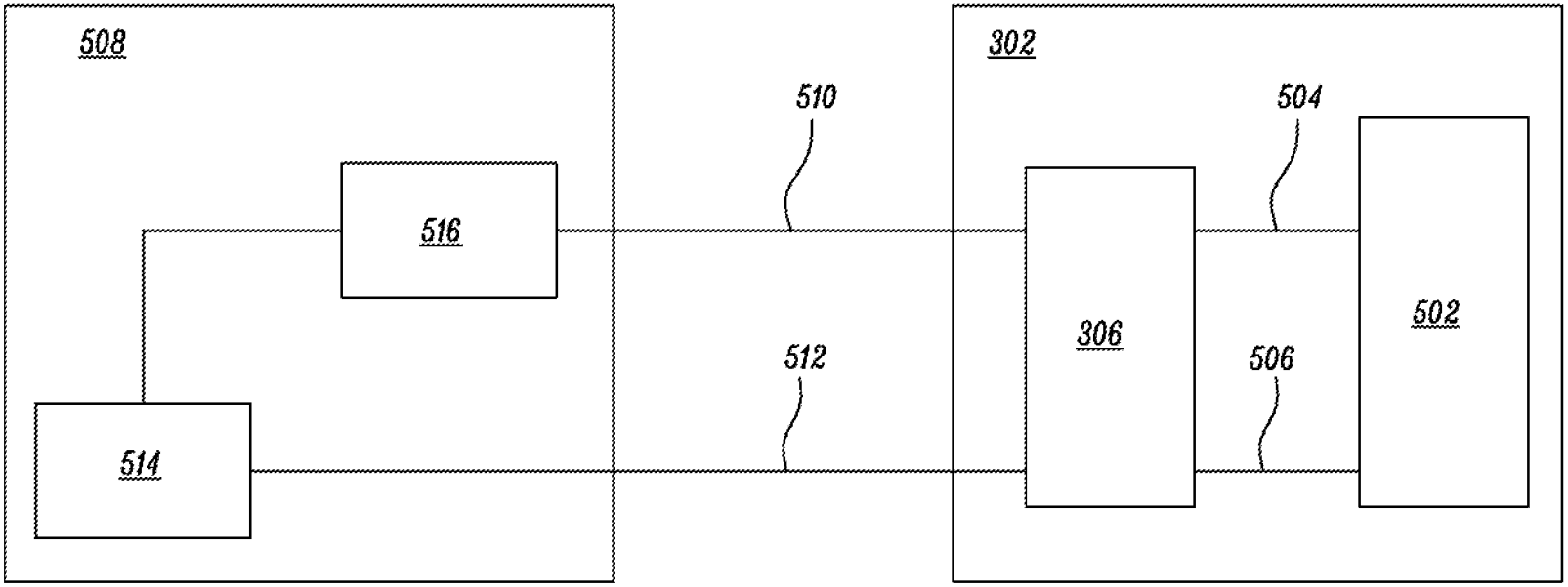
FIG. 4 is a schematic view of a power cell of the hydraulic hammer, according to one embodiment of the present disclosure.

FIG. 4 shows a schematic view of the power cell 302. Referring to FIGS. 3 and 4, the power cell 302 includes the piston 502 that reciprocates within the main housing 304. The piston 502 may further impact the work tool 118 (shown in FIG. 2) during operation of the hammer 102. The piston 502 may be actuated by a controlled flow of the working fluid to and from the power cell 302. The valve assembly 306 may regulate the flow of the working fluid to one or more fluid chambers (not shown) associated with the piston 502 via fluid passages 504 and 506. Specifically, the valve assembly 306 may provide pressurized working fluid to drive the piston 502 towards the work tool 118 during a work stroke and to return the piston 502 during a return stroke. In various embodiments, the valve assembly 306 may include one or more valves (not shown) to control the flow of the working fluid. The valves may be mechanically operated valves, electronically controlled valves, pilot operated valves, and so forth.

The valve assembly 306 is further fluidly connected to a hydraulic system 508 of the machine 100 (shown in FIG. 1) via fluid lines 510 and 512. The valve assembly 306 may be fluidly connected to the fluid lines 510 and 512 via the fluid connectors 324. The hydraulic system 508 may include a tank 514 and a pump 516. The pump 516 is in fluid communication with the tank 514. The hydraulic system 508 may be powered by a power source (not shown) of the machine 100. The hydraulic system 508 may also include additional components (not shown), for example, one or more valves, filters, sensors, and so forth. The fluid line 510 may supply pressurized working fluid to the valve assembly 306 from the pump 516. The fluid line 512 may provide a return path of the working fluid from the valve assembly 306 to the tank 514.

Figure 5:
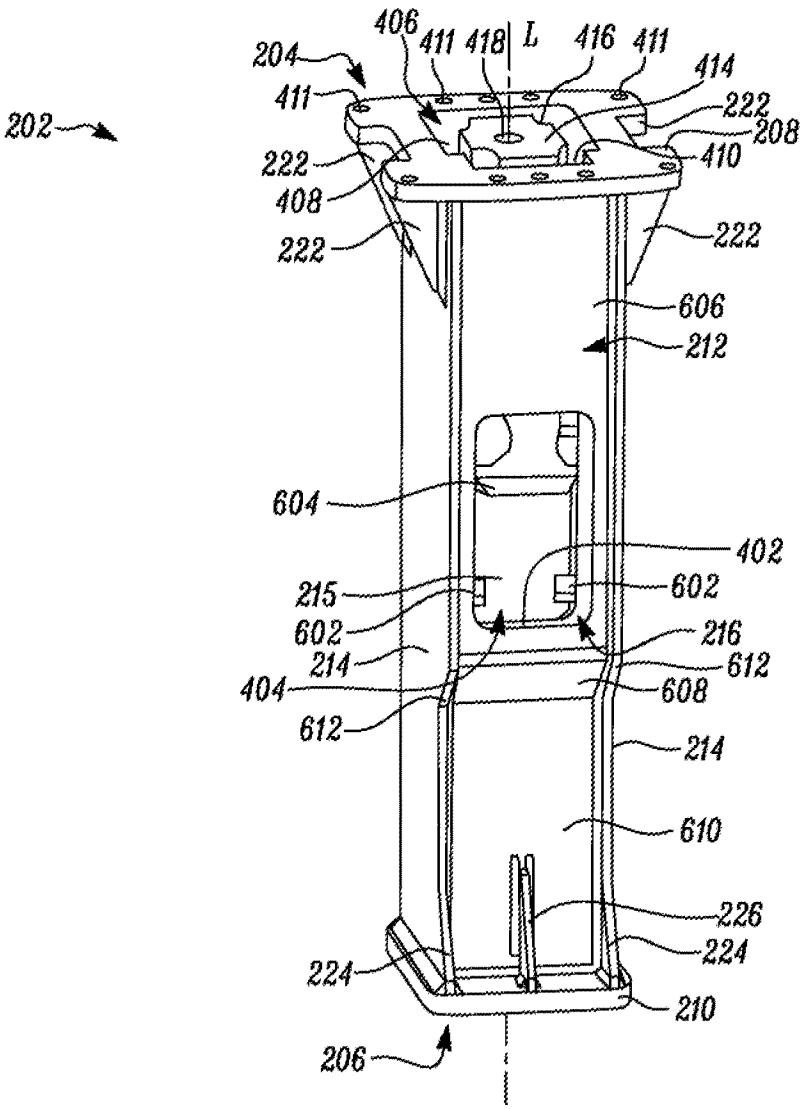
FIG. 5 is a perspective view of a housing of the hydraulic hammer, according to one embodiment of the present disclosure.

FIG. 5 illustrates a perspective view of the housing 202. The wear plates 602 may be disposed around the cutout 404 defined by the internal wall 402. Each of the wear plates 602 is coupled to at least one of the power cell 302 (shown in FIG. 3) and the housing 202. In an embodiment, each of the wear plates 602 may be detachably coupled to the internal wall 402 of the housing 202 by various methods, such as fasteners, pegs, a snap-fit connection, and so forth. A middle buffer 604 of the hammer 102 is also disposed within the housing 202. The middle buffer 604 may be coupled to the rear wall 215 and/or side walls 214 of the housing 202. The middle buffer 604 may have any suitable shape as per application requirements. The top buffer 414 is disposed proximate to the top end 204 of the housing 202.

The external wall 212 is spaced apart from the internal wall 402. Further, the external wall 212 includes a top portion 606, an inclined portion 608, and a bottom portion 610. The top portion 606 is proximal to the top end 204 of the housing 202. The bottom portion 610 is proximal to the bottom end 206 of the housing 202. The bottom handling portion 226 is further located in the bottom portion 610 of the external wall 212. The inclined portion 608 is disposed between the top portion 606 and the bottom portion 610. The top portion 606 and the bottom portion 610 may extend substantially parallel to the longitudinal axis 'L' of the housing 202. The inclined portion 608 may be inclined at an angle with respect to the longitudinal axis 'L'. Each of the side walls 214 also includes a sloped portion 612 located on a side of the inclined portion 608. Each of the sloped portions 612 may also be inclined at an angle with respect to the longitudinal axis 'L'.

Figure 6:
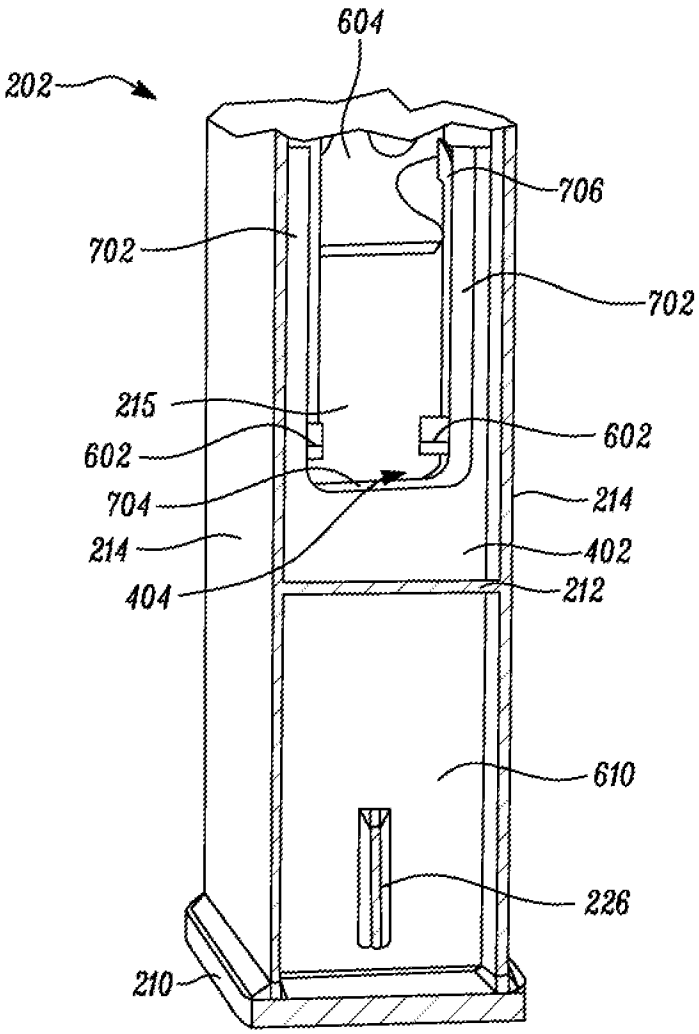
FIG. 6 is a partial perspective view of the housing, according to one embodiment of the present disclosure.

FIG. 6 illustrates a partial perspective view of the housing 202 with a part of the external wall 212 removed. Specifically, the top and inclined portions 606, 608 of the external wall 212 have been removed for illustrative purposes. The internal wall 402 includes a pair of elongate portions 702 extending from an upper edge 704. The elongate portions 702 and the upper edge 704 together define the cutout 404. Each of the elongate portions 702 may have a rectangular shape. The interface between each of the elongate portions 702 and the upper edge 704 may be rounded to provide the cutout 404 with a U-shape. A pair of lateral members 706 (only one shown in FIG. 6) may extend transversely from the internal wall 402 towards the rear wall 215. Specifically, each of the lateral members 706 may extend from the corresponding elongate portion 702 of the internal wall 402. The lateral members 706 may guide the valve assembly 306 (shown in FIG. 3) during insertion or removal of the power cell 302 from the housing 202.

Figure 7:
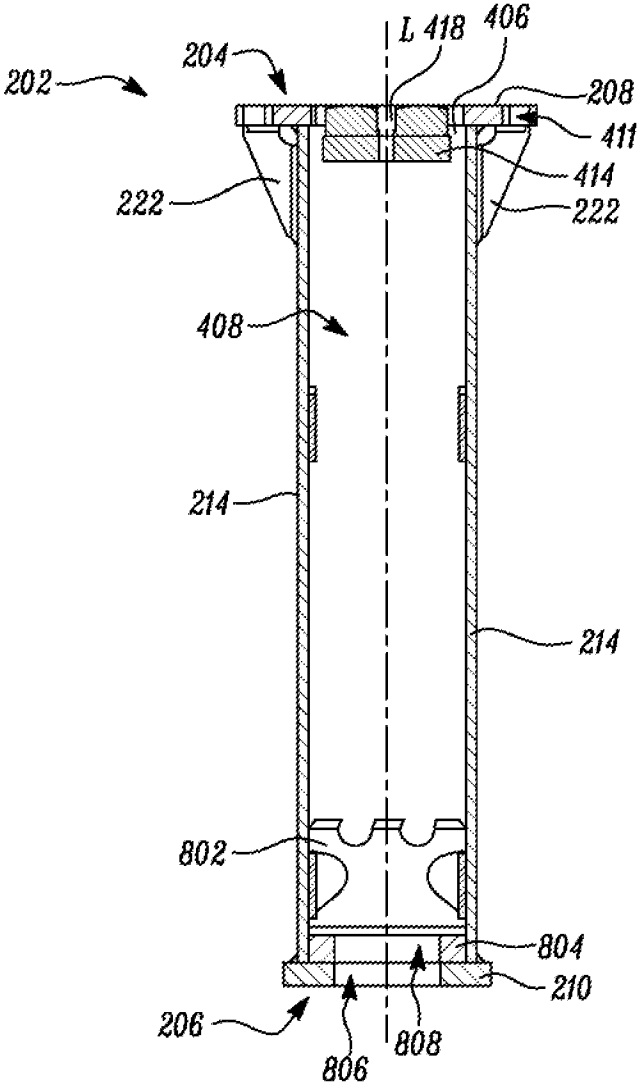
FIG. 7 is a sectional view of the housing, according to one embodiment of the present disclosure.
Figure 8:
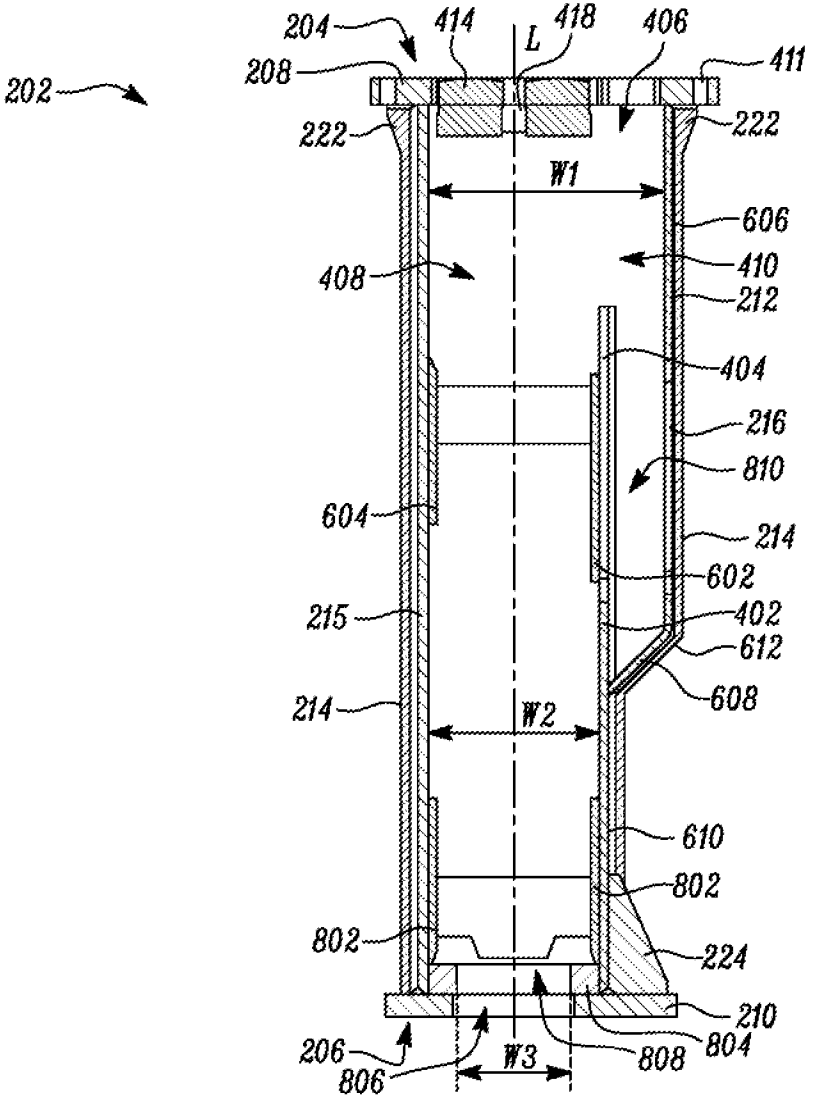
FIG. 8 is another sectional view of the housing, according to one embodiment of the present disclosure.

FIGS. 7 and 8 illustrate different sectional views of the housing 202. The top buffer 414 is disposed at the top end 204 of the housing 202. Referring to FIGS. 7 and 8, a pair of bottom buffers 802 of the hammer 102 is disposed proximate to the bottom end 206 of the housing 202. However, the hammer 102 may have any number of bottom buffers 802 as per application requirements. Each of the bottom buffers 802 may be disposed adjacent to a support portion 804 of the housing 202. The support portion 804 is further disposed on the bottom flange 210 of the housing 202. The bottom buffers 802 are disposed opposite to each other. The bottom buffers 802 may be removably coupled to one or more parts of the housing 202 by various methods, such as mechanical fasteners, a snap-fit connection, and the like. One of the bottom buffers 802 may be removably coupled to the rear wall 215. The other bottom buffer 802 may be removably coupled to the bottom portion 610 of the external wall 212. Each of the bottom buffers 802 may have any suitable shape as per application requirements. In an embodiment, each of the bottom buffers 802 may be chamfered at both top and bottom ends.

The middle buffer 604 is disposed between the top buffer 414 and one of the bottom buffers 802 with respect to the longitudinal axis 'L' of the housing 202. The middle buffer 604 may be removably coupled to the rear wall 215 of the housing 202. Further, the middle buffer 604 may be located opposite to the cutout 404 and the wear plates 602 (only one shown in FIG. 8). In an embodiment, the middle buffer 604 may be chamfered at both top and bottom ends. In another embodiment, the middle buffer 604 and each of the bottom buffers 802 may have a substantially similar configuration. The top, middle, and bottom buffers 414, 604, 802 and the wear plates 602 may form a buffer system of the hammer 102.

Each of the top, middle, and bottom buffers 414, 604, 802 may act as a sacrificial material, and prevent the components of the power cell 302 from being subjected to wear and abrasion during operation of the hammer 102. The top, middle, and bottom buffers 414, 604, 802 may further isolate at least a part of the power cell 302 from the housing 202. Specifically, the top, middle, and bottom buffers 414, 604, 802 may isolate the main housing 304 of the power cell 302 from the housing 202. The top, middle, and bottom buffers 414, 604, 802 may also protect inner surfaces of the housing 202 by presenting a sacrificial surface. Similarly, the wear plates 602 may protect the valve assembly 306 from wear and abrasion during operation of the hammer 102. Each of the top, middle, and bottom buffers 414, 604, 802 may be made of a non-metallic material, for example, but not limited to, rubber, urethane, nylon, ultra-high-molecular-weight polyethylene (UHMW), and so forth.

The housing 202 further includes a bottom opening 806 disposed at the bottom end 206. The bottom opening 806 is defined by the bottom flange 210 and extends therethrough. The support portion 804 also defines a support opening 808 extending therethrough. The support opening 808 may be axially aligned with the bottom opening 806 of the bottom flange 210. The work tool 118 (shown in FIG. 2) extends through the bottom opening 806. Further, the side walls 214 extend beyond the external wall 212 along a direction that is perpendicular to the longitudinal axis 'L' of the housing 202. Further, the front opening 216 may be substantially aligned with the cutout 404. The side walls 214 may also extend beyond the rear wall 215 along a direction that is perpendicular to the longitudinal axis 'L' of the housing 202. The rear wall 215 may be disposed between the side walls 214.

The housing 202 further defines a hollow volume for slidably receiving the power cell 302 therein. The house opening 406 may extend at least partially along the length of the housing 202 to define the hollow volume. The first portion 408 of the house opening 406 may extend from the top end 204 of the housing 202 to the support portion 804. The main housing 304 (shown in FIG. 3) of the power cell 302 is received within the first portion 408. The valve assembly 306 may be slidably inserted or removed through the second portion 410 of the house opening 406. The second portion 410 may extend from the top end 204 of the housing 202 to an upper edge of the inclined portion 608 of the external wall 212. Therefore, a width of the hollow volume defined by the housing 202 varies along the longitudinal axis 'L'. The hollow volume may have a first width 'W1' till the upper edge of the inclined portion 608. Further, the hollow volume may have a second width 'W2' from a lower edge of the inclined portion 608 to the support portion 804. The first width 'W1' may be larger than the second width 'W2'. The first width 'W1' may accommodate both the main housing 304 and the valve assembly 306 of the power cell 302. The second width 'W2' may accommodate only the main housing 304 of the power cell 302. The inclined portion 608 of the external wall 212 and the sloped portions 612 of the side walls 214 may act as a transition region between the first width 'W1' and the second width 'W2'. Further, the support opening 808 has a third width 'W3'. The support opening 808 may at least partially receive the bottom part 310 (shown in FIG. 3) of the power cell 302.

Upon insertion within the housing 202, the valve assembly 306 extends through the cutout 404 towards the external wall 212. Specifically, the valve assembly 306 extends into a space 810 defined between the internal wall 402 and the external wall 212. The internal wall 402 further extends upwards from the lower edge of the inclined portion 608 of the external wall 212. In an embodiment, the internal wall 402 may be integral with the bottom portion 610 of the external wall 212. In another embodiment, the internal wall 402 may be joined to the bottom portion 610.

Figure 9:
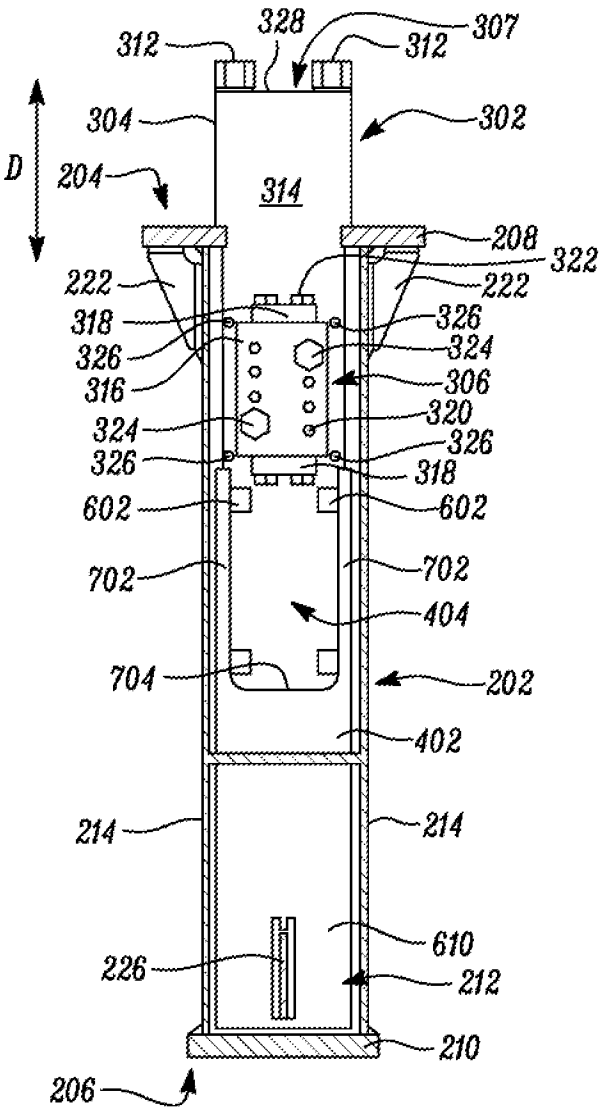
FIG. 9 illustrates a partial front view of the power cell being partly inserted into the housing, according to one embodiment of the present disclosure.

FIG. 9 illustrates the power cell 302 being partially inserted into the housing 202. A part of the external wall 212 has been removed for the purpose of illustration. The power cell 302 may be inserted substantially parallel to the axial direction 'D'. The main housing 304 of the power cell 302 defines two pairs of the apertures 326. The apertures 326 are disposed around the valve assembly 306. Specifically, one of the pair of apertures 326 are disposed on one side of the valve assembly 306, while the other pair of apertures 326 are disposed on the opposite side. Each of the pair of apertures 326 are coupled to the corresponding wear plate 602 (shown in FIG. 3). In an embodiment, the apertures 326 may be drilled into the main housing 304. The cutout 404 may allow the valve assembly 306 to be inserted into or removed from the housing 202. Further, the valve assembly 306 is at least partially received in the cutout 404 upon insertion within the housing 202.

Figure 10:
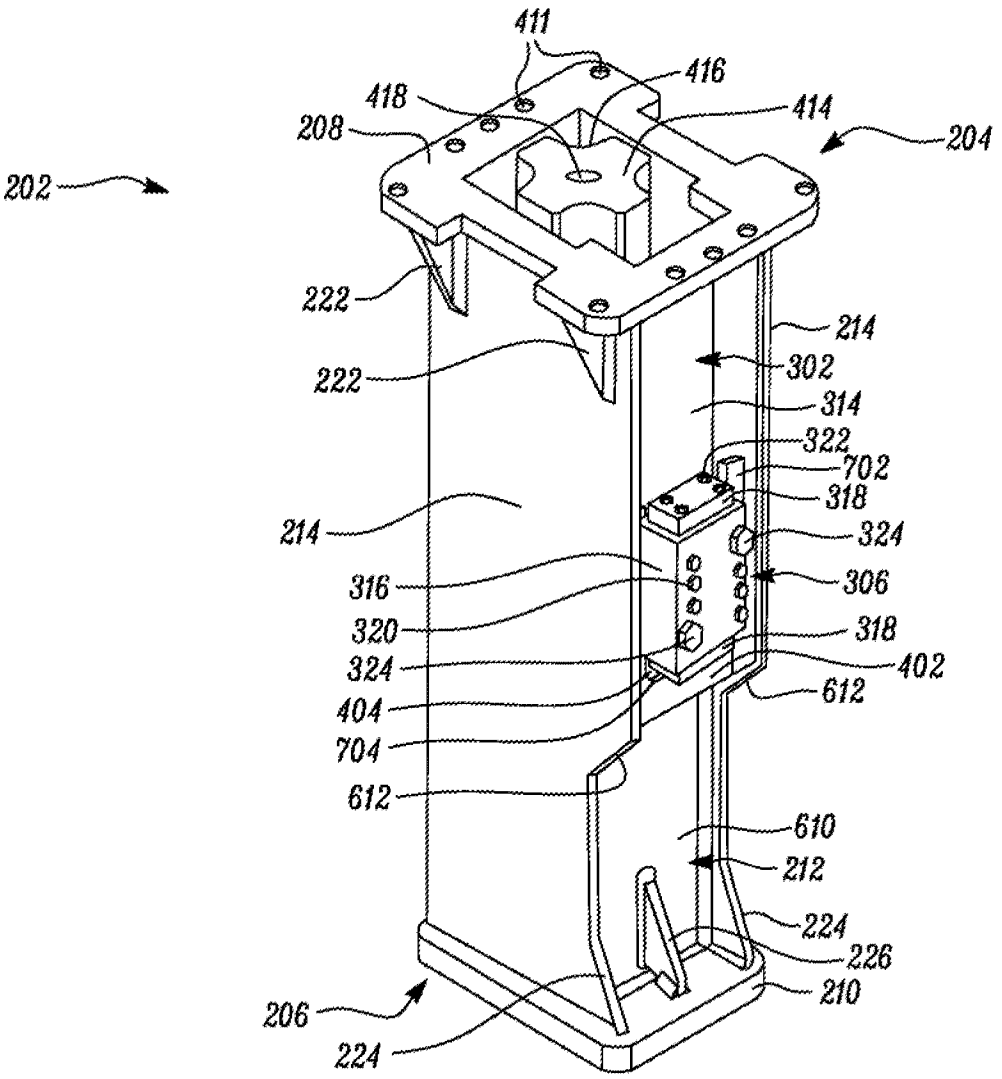
FIG. 10 illustrates a partial perspective view of the power cell fully inserted within the housing, according to one embodiment of the present disclosure.

FIG. 10 illustrates the power cell 302 fully inserted within the housing 202. A part of the external wall 212 has been removed for the purpose of illustration. In the inserted state, the valve assembly 306 is at least partially received within the cutout 404. Further, the valve assembly 306 may extend through the cutout 404. The top buffer 414 is disposed on the power cell 302.

Figure 11:
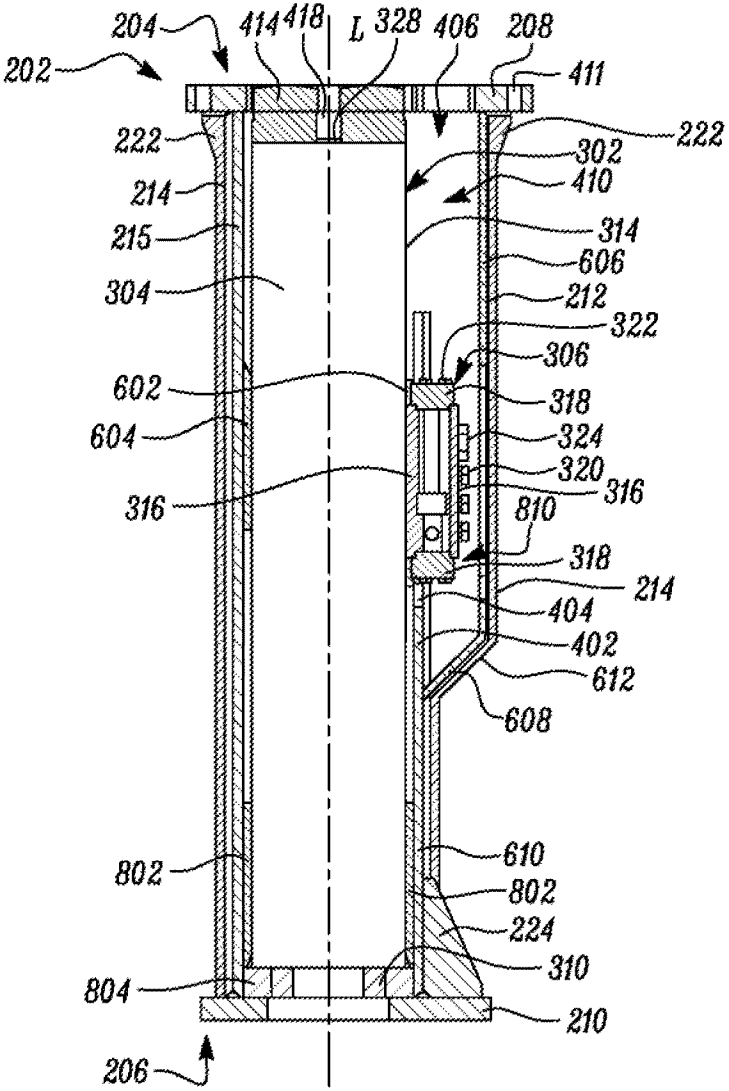
FIG. 11 illustrates a sectional view of the power cell fully inserted within the housing, according to one embodiment of the present disclosure.

FIG. 11 illustrates a sectional view of the power cell 302 fully inserted within the housing 202. Various internal components of the power cell 302 have been omitted for the purpose of illustration. Referring to FIGS. 8 and 11, the main housing 304 of the power cell 302 is received within the first portion 408 of the house opening 406. The valve assembly 306 is at least partially received within the cutout 404 and extends into the space 810 defined between the internal wall 402 and the external wall 212. The bottom part 310 is at least partially received within the support opening 808 of the support portion 804. The top buffer 414 is disposed on the top surface 328 of the main housing 304. The middle and bottom buffers 604, 802 abut the main housing 304 of the power cell 302. In an embodiment, the middle and bottom buffers 604, 802 may be removably coupled to the main housing 304.

Figure 12:
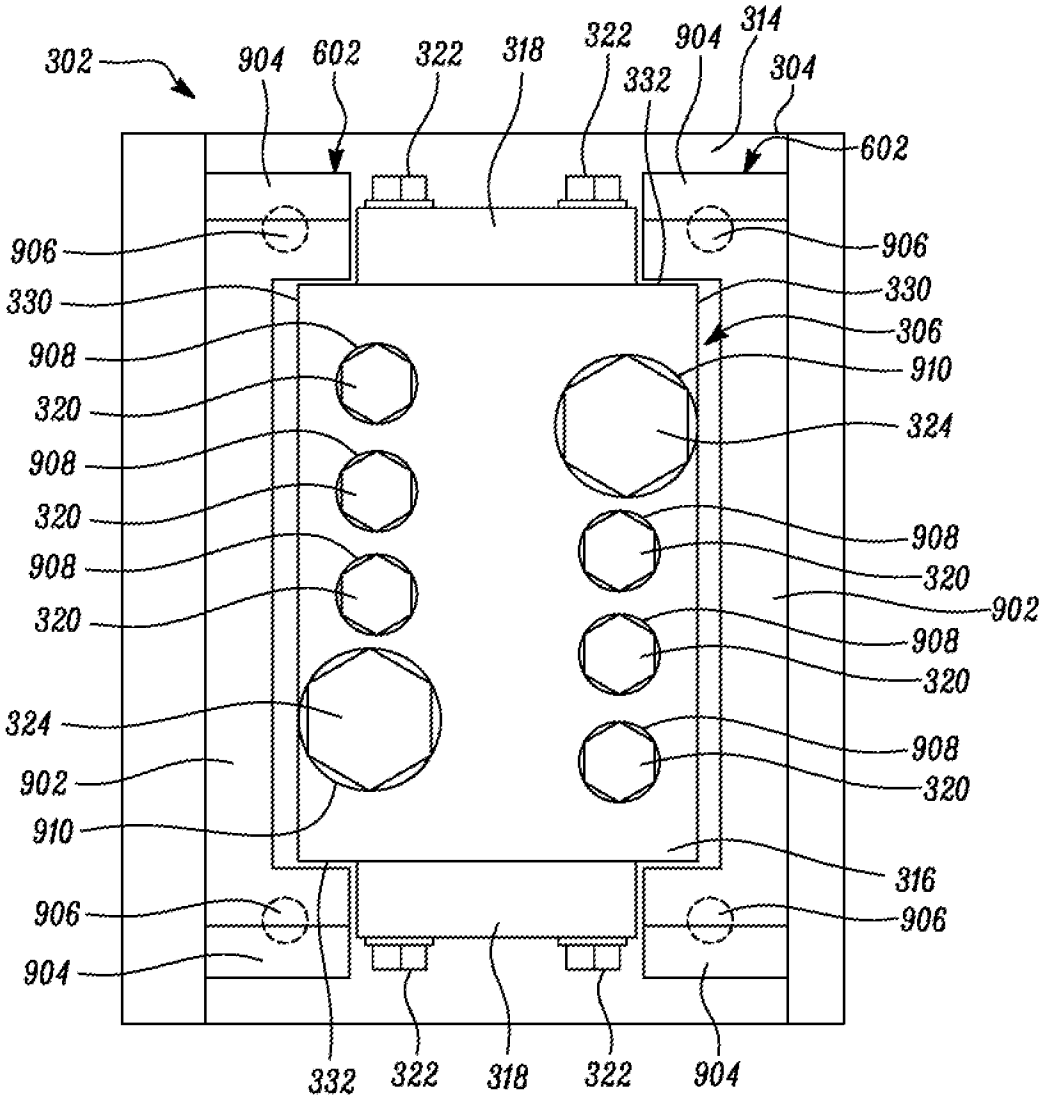
FIG. 12 illustrates a front view of a valve assembly of the power cell, according to one embodiment of the present disclosure.

FIG. 12 illustrates a front view of the valve assembly 306. The wear plates 602 at least partially surround the valve assembly 306 on opposite sides. Each of the wear plates 602 includes an elongate section 902 and a pair of lateral sections 904 extending from opposite ends of the elongate section 902. The pair of lateral sections 904 may be oriented substantially perpendicular to the elongate section 902. Each of the lateral sections 904 includes a projecting portion 906 that is adapted to be removably received within the corresponding aperture 326 (shown in FIG. 9) of the main housing 304. Therefore, each of the pair of wear plates 602 includes a pair of the projecting portions 906 adapted to be removably received within the corresponding apertures 326 of the main housing 304 of the power cell 302. In an embodiment, the wear plates 602 may be connected to the power cell 302 prior to insertion within the housing 202. In another embodiment, the wear plates 602 may be connected to the power cell 302 upon insertion of the power cell 302 within the housing 202. In an alternative embodiment, the wear plates 602 may be removably attached to the internal wall 402 (shown in FIG. 6) of the housing 202.

The main portion 316 of the valve assembly 306 further includes a pair of longitudinal edges 330 opposite to each other and a pair of lateral edges 332 opposite to each other. The elongate section 902 of each of the wear plates 602 is proximal to the corresponding longitudinal edge 330 of the main portion 316. Further, the elongate section 902 of each of the wear plates 602 may be oriented substantially parallel to the corresponding longitudinal edge 330 of the main portion 316. The lateral sections 904 of each of the wear plates 602 are proximal to the corresponding lateral edges 332 of the main portion 316. Further, the lateral sections 904 of each of the wear plates 602 are oriented substantially parallel to the corresponding lateral edges 332 of the main portion 316.

The wear plates 602 may protect the valve assembly 306 from wear and abrasion during operation of the hammer 102. Further, the wear plates 602 may retain the valve assembly 306 in place. Each of wear plates 602 may be made of a non-metallic material, for example, but not limited to, rubber, urethane, nylon, ultra-high-molecular-weight polyethylene (UHMW), and so forth.

The main portion 316 of the valve assembly 306 further defines six first apertures 908 and two second apertures 910. Three of the first apertures 908 and one of the second apertures 910 are arranged in a column proximal to one of the longitudinal edges 330 of the main portion 316. Similarly, the other three of the first apertures 908 and the other second aperture 910 are arranged in another column proximal to the other longitudinal edge 330 of the main portion 316. Further, the arrangement of the first apertures 908 and the second aperture 910 in one column is reversed with respect to the other column. Specifically, the second aperture 910 is located at the top in one column, while the second aperture 910 is located at the bottom in another column. Each of the first apertures 908 receives the corresponding first fastener 320. The first fasteners 320 may couple the main portion 316 of the valve assembly 306 to the main housing 304 of the power cell 302. Each of the second apertures 910 receives the corresponding fluid connector 324.

Figure 13:
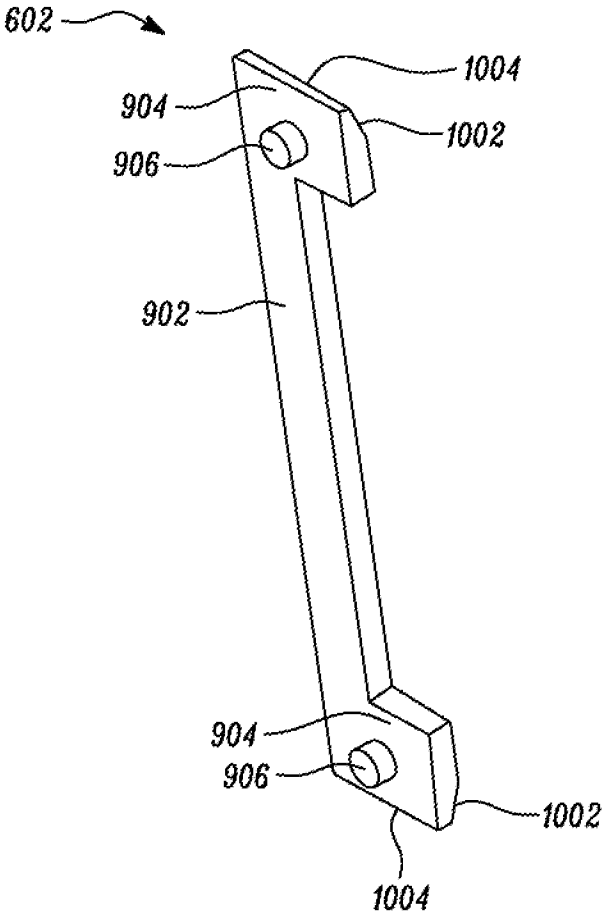
FIG. 13 illustrates a perspective view of a wear plate of the hydraulic hammer, according to one embodiment of the present disclosure.

FIG. 13 illustrates a perspective view of one of the wear plates 602. The elongate section 902 may have a rectangular shape. Each lateral section 904 of the wear plate 602 includes a chamfered region 1002 that extends from a corresponding end 1004 of the wear plate 602. The projecting portions 906 are located on a surface that faces the main housing 304 (shown in FIG. 3) of the power cell 302. Further, the chamfered regions 1002 and the projecting portions 906 are located on opposite surfaces. Each of the projecting portions 906 may have a cylindrical shape. Further, each of the projecting portions 906 may be embodied as pegs that are removably received within the corresponding aperture 326 (shown in FIG. 9) of the power cell 302.

Figure 14B:
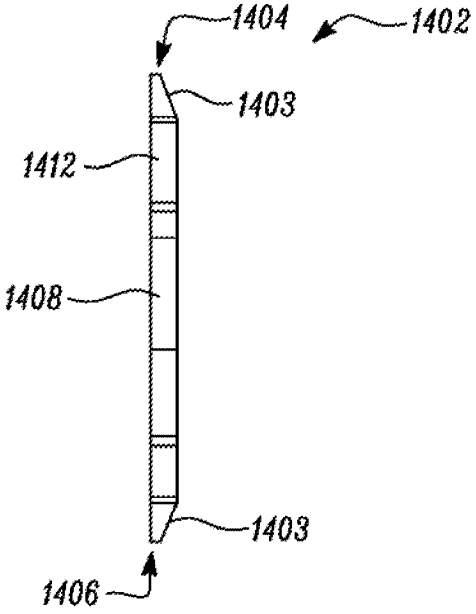
FIG. 14B illustrates a side view of the buffer member of FIG. 14B.
Figure 14A:
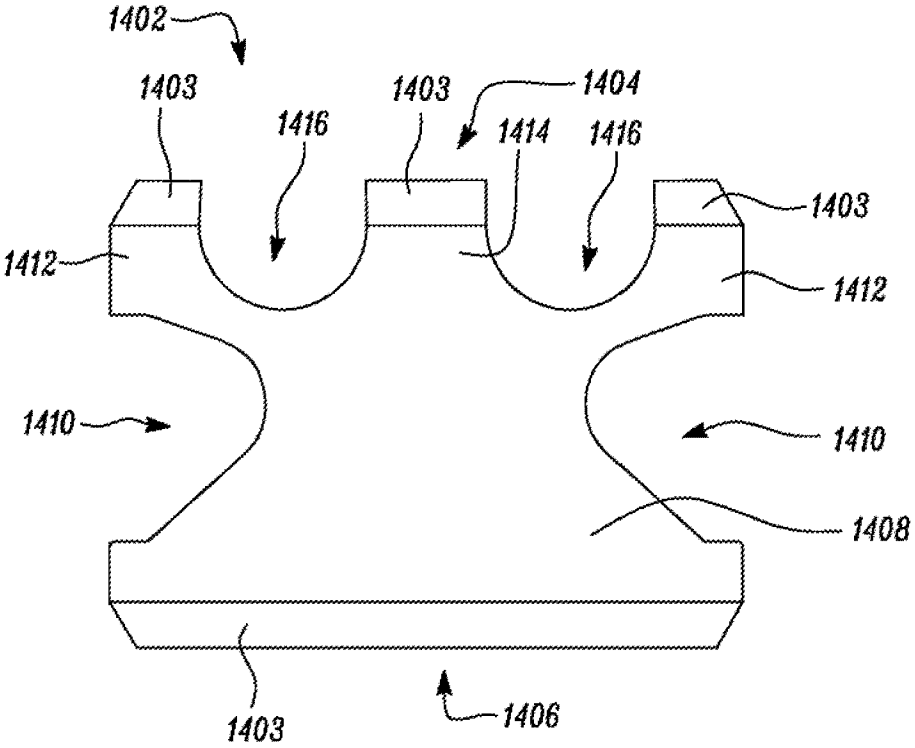
FIG. 14A illustrates a front view of a buffer member of the hydraulic hammer, according to one embodiment of the present disclosure.

FIGS. 14A and 14B illustrate different views of a buffer member 1402. In an embodiment, the buffer member 1402 may act as both the middle buffer 604 and each of the bottom buffers 802 (shown in FIG. 8) of the hammer 102. The buffer member 1402 includes a top buffer end 1404 and a bottom buffer end 1406. The buffer member 1402 includes chamfered portions 1403 at each of the top and bottom buffer ends 1404, 1406. The buffer member 1402 further includes a main body 1408 defining a pair of lateral recesses 1410 opposite to each other. The buffer member 1402 further includes a pair of lateral projections 1412 and a middle projection 1414 extending from the main body 1408. The middle projection 1414 and each of the lateral projections 1412 define a top recess 1416 between them.

INDUSTRIAL APPLICABILITY

The present disclosure relates to the hammer 202 with the valve assembly 306 that is externally mounted on the power cell 302. The hammer includes the housing 202 that defines the cutout 404. The cutout 404 may allow the power cell 302 to be easily inserted into or removed from the housing 202. The power cell 302 may have to be removed from the housing 202 for servicing and/or replacement.

The valve assembly 306 may slide into the cutout 404 upon insertion of the power cell 302 into the housing 202. In order to remove the power cell 302 from the housing 202, the mounting bracket 110 may have to be disconnected and removed from the top flange 208 of the housing 202. The top buffer 414 which freely rests on the top surface 328 of the power cell 302 may be easily removed without using any tools. The power cell 302 including the valve assembly 306 may be then slidably removed from the housing 202. After removal of the mounting bracket 110, the power cell 302 may therefore be removed from the housing 202 without requiring the disconnection of additional parts using tools. This may reduce downtime and requirement of tools to service and/or replace the power cell 302.

The wear plates 602 may also protect the valve assembly 306 from wear and abrasion during operation of the hammer 202. The wear plates 602 may be easily attached to or removed from the power cell 302 and/or the housing 202.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A hydraulic hammer comprising:

a housing defining a cutout and a longitudinal axis;

a power cell slidably received with the housing, the power cell including a valve assembly extending from a side of the power cell, wherein the valve assembly is at least partially received within the cutout of the housing; and a pair of wear plates at least partially disposed around the valve assembly of the power cell, wherein each wear plate includes an elongate section and a pair of lateral sections extending from opposite ends of the elongate section, wherein the elongate section is oriented parallel to the longitudinal axis and each lateral section is oriented perpendicular to the elongate section, and wherein each of the pair of wear plates is coupled to at least one of the power cell and the housing.

2. The hydraulic hammer of claim 1, wherein the cutout is U-shaped.

3. The hydraulic hammer of claim 1, wherein the cutout is defined by an internal wall of the housing.

4. The hydraulic hammer of claim 3, wherein the housing further comprises an external wall spaced apart from the internal wall, and wherein the valve assembly extends through the cutout towards the external wall.

5. The hydraulic hammer of claim 1, wherein each lateral section of each wear plate includes a projecting portion adapted to be removably received within corresponding apertures of the power cell.

6. The hydraulic hammer of claim 1, further comprising a top buffer disposed proximate to a top end of the housing.

7. The hydraulic hammer of claim 6, further comprising a bottom buffer disposed proximate to a bottom end of the housing.

8. The hydraulic hammer of claim 7, further comprising a middle buffer disposed between the top buffer and the bottom buffer.

9. A hydraulic hammer comprising:

a housing defining a cutout and a longitudinal axis, wherein the cutout is U-shaped;

a power cell slidably received within the housing, the power cell including a valve assembly extending from a side of the power cell and a plurality of apertures disposed around the valve assembly, wherein the valve assembly is at least partially received within the cutout of the housing; and a pair of wear plates at least partially disposed around the valve assembly of the power cell, wherein each wear plate includes an elongate section and a pair of lateral sections extending from opposite ends of the elongate section, wherein the elongate section is oriented parallel to the longitudinal axis and each lateral section is oriented perpendicular to the elongate section, and wherein each lateral section of each wear plate includes a peg adapted to be removably received within corresponding apertures of the plurality of apertures of the power cell.

10. The hydraulic hammer of claim 9, wherein the cutout is defined by an internal wall of the housing.

11. The hydraulic hammer of claim 10, wherein the housing further comprises an external wall spaced apart from the internal wall, and wherein the valve assembly extends through the cutout towards the external wall.

12. The hydraulic hammer of claim 9, further comprising a top buffer disposed proximate to a top end of the housing.

13. The hydraulic hammer of claim 12, further comprising a bottom buffer disposed proximate to a bottom end of the housing.

14. The hydraulic hammer of claim 13, further comprising a middle buffer disposed between the top buffer and the bottom buffer.

15. A hydraulic hammer comprising:

a housing having a top end and a bottom end, wherein the housing defines a cutout and a longitudinal axis;

a power cell slidably received within the housing, the power cell including a valve assembly extending from a side of the power cell, wherein the valve assembly is at least partially received within the cutout of the housing;

a pair of wear plates at least partially disposed around the valve assembly of the power cell, wherein each wear plate includes an elongate section and a pair of lateral sections extending from opposite ends of the elongate section, wherein the elongate section is oriented parallel to the longitudinal axis and each lateral section is oriented perpendicular to the elongate section, and wherein each of the pair of wear plates is coupled to one of the power cell and the housing;

a top buffer disposed proximate to the top end of the housing; and a bottom buffer disposed proximate to the bottom end of the housing.

16. The hydraulic hammer of claim 15, wherein the cutout is U-shaped.

17. The hydraulic hammer of claim 15, wherein the cutout is defined by an internal wall of the housing.

18. The hydraulic hammer of claim 17, wherein the housing further comprises an external wall spaced apart from the internal wall, and wherein the valve assembly extends through the cutout towards the external wall.

19. The hydraulic hammer of claim 15, wherein each lateral section of each wear plate includes a projecting portion adapted to be removably received within corresponding apertures of the power cell.

20. The hydraulic hammer of claim 15, further comprising a middle buffer disposed between the top buffer and the bottom buffer.

* * * * *